United States Patent [19]

Yeh et al.

[11] Patent Number: 4,878,442

[45] Date of Patent: Nov. 7, 1989

[54] NOX CONTROL FOR HIGH NITRIC OXIDE CONCENTRATION FLOWS THROUGH COMBUSTION-DRIVEN REDUCTION

[75] Inventors: James T. Yeh; James M. Ekmann; Henry W. Pennline, all of Bethel Park; Charles J. Drummond, Churchill, all of Pa.

[73] Assignee: The United States of America as represented by the Department of Energy, Washington, D.C.

[21] Appl. No.: 207,995

[22] Filed: Jun. 17, 1988

[51] Int. Cl.[4] ..... F23J 11/00; F23J 15/00

[52] U.S. Cl. ..... 110/345; 110/342; 110/347; 422/168; 423/139

[58] Field of Search ..... 423/235, 235 D, 239, 423/239 A; 422/168; 110/347, 345, 342

[56] References Cited

U.S. PATENT DOCUMENTS

| | | | |
|---|---|---|---|
| 4,411,204 | 10/1983 | Hamilton | 110/347 |
| 4,612,175 | 9/1986 | Harkness et al. . | |
| 4,615,780 | 10/1986 | Walker . | |
| 4,699,071 | 10/1987 | Vier et al. | 110/345 |
| 4,782,770 | 11/1988 | Carlson . | |

OTHER PUBLICATIONS

Carlson, U.S. Statutory Invention Registration No. H19.

U.S. patent application Ser. No. 148, 513 filed Jan. 26, 1988; Allowed May 24, 1988.

Wendt et al., "Reduction of Sulfur Trioxide and Nitrogen Oxides by Secondary Fuel Injection", Fourteenth Symposium (Internat'l ) on Combustion, the Combustion Inst., 1973.

Neal, "Evaluation of the NOXSO Combines $No_x/SO_2$ Treatment Process", Flue Gas Cleanup Contractors' Review Meeting, U.S. DOE, 1984.

Yeh et al., "New Strategy to Decomposie Nitrogen Oxides From Regenerable Flue Gas Cleanup Processes", 194th ACS National Meeting, Aug. 30–Sep. 4, 1987.

*Primary Examiner*—Edward G. Favors

*Attorney, Agent, or Firm*—Hugh W. Glenn; Paul A. Gottlieb; Judson R. Hightower

[57] ABSTRACT

An improved method for removing nitrogen oxides from concentrated waste gas streams, in which nitrogen oxides are ignited with a carbonaceous material in the presence of substoichiometric quantities of a primary oxidant, such as air. Additionally, reductants may be ignited along with the nitrogen oxides, carbonaceous material and primary oxidant to achieve greater reduction of nitrogen oxides. A scrubber and regeneration system may also be included to generate a concentrated stream of nitrogen oxides from flue gases for reduction using this method.

29 Claims, 2 Drawing Sheets

NOX CONTROL FOR HIGH NITRIC OXIDE CONCENTRATION FLOWS THROUGH COMBUSTION-DRIVEN REDUCTION

CONTRACTUAL ORIGIN OF THE INVENTION

The United States Government has rights in this invention pursuant to the employee/employer relationship of the inventors to the United States Department of Energy at the Pittsburgh Energy Technology Center.

BACKGROUND OF THE INVENTION

The present invention relates to a new method for destroying high concentrations of nitric oxides in gas streams. These streams may be recycle streams from regenerable $NO_x$ scrubbers for flue gas applications, or they may be industrial waste streams such as those from nitrification processes in the chemical industry.

Flue gases resulting from the combustion of carbonaceous material typically contain substantial quantities of pollutants, including nitrogen oxides. These pollutants combine with other substances found in the atmosphere to produce serious environmental hazards, such as acid rain and smog. It is therefore desirable to remove these pollutants from flue gases before they are dispersed into the atmosphere. It is also desirable to decompose these pollutants into other substances not having the deleterious environmental consequences possessed by nitrogen oxides.

There are two types of methods by which the quantities of $NO_x$ dispersed from combustion systems may be reduced. One type, known in the art as combustion modification, requires control over the combustion reaction producing the pollutant. These techniques have generally achieved fifty to sixty percent reductions in $NO_x$ emissions from conventional combustion systems.

A specific type of combustion modification, known as reburning, has achieved reductions approaching seventy percent. Using this technique, a secondary fuel source as introduced downstream of the primary combustion zone in the combustor to achieve reductions of $NO_x$. This technique, however, is disadvantageous in that it requires large amounts of secondary fuel to accomplish the reburning of $NO_x$, and additionally requires downstream injection ports in the combustor to effectively control $NO_x$ levels in the effluent stream. This method is not effective when more than seventy percent removal of effluent $NO_x$ is required.

The second type of $NO_x$ removal methods is known as post-combustion cleanup, whereby the pollutant is removed downstream of its formation. These techniques are more complex and expensive than combustion modification techniques, but are useful when $NO_x$ reduction levels higher than seventy percent are necessary. In systems employing this technique, a dry scrubbing sorbent or an aqueous sorbent, such as an active metal chelate, are typically used to remove $NO_x$ and other pollutants. Certain systems, such as that proposed by Walker, U.S. Pat. No. 4,615,780, additionally incorporate the step of regenerating the sorbent and producing a concentrated stream of $NO_x$ which can be recycled as part of the combustion air. This concentrated $NO_x$ is destroyed in the combustor and elemental nitrogen and oxygen are produced. This system produces maximum reductions of 60 to 70 percent of the $NO_x$ produced by combustion, substantially less as compared to the present invention.

Another scrubber system, proposed by Harkness, et al, U.S. Pat. No. 4,612,175, uses active Fe(II)EDTA as the chelate to remove NO from flue gases simultaneously with the removal of $SO_2$. This method, however, produces as an end product aqueous hydroxylamine disulfonate and other sulfonates in a sludge with the aqueous sorbent. These products in themselves create environmental hazards which render the process described by Harkness disadvantageous.

It should be noted that the source of the high concentration $NO_x$ stream may be, as described above, a recycle stream from a regenerable scrubber or an industrial waste gas stream, such as that from nitrification processes as used in the chemical industry, high temperature smelting plants, nitric acid manufacturing plants, and any other process where a high concentration of $NO_x$ is in the waste stream. The present invention relates to removal and destruction of $NO_x$ from such high $NO_x$ concentration waste gas streams.

SUMMARY OF THE INVENTION

The method described herein provides a technique for removing introgen oxides from gas streams, discharged from the combustion of carbonaceous materials, in greater quantities than previously known.

It is also an object of the invention to provide a method for the removal of $NO_x$ resulting in the production of effluent streams of elemental nitrogen and oxygen.

It is a further object of the invention to provide a method for $NO_x$ removal in which a reductant gas is used to further lower the concentration of $NO_x$ in the effluent stream.

Another object of the invention is to provide a method wherein unconverted $NO_x$ is removed from the discharge stream by a regenerable scrubber and recycled to the combustion device for conversion into elemental nitrogen and oxygen.

DETAILED DESCRIPTION OF THE INVENTION

Figure 1:
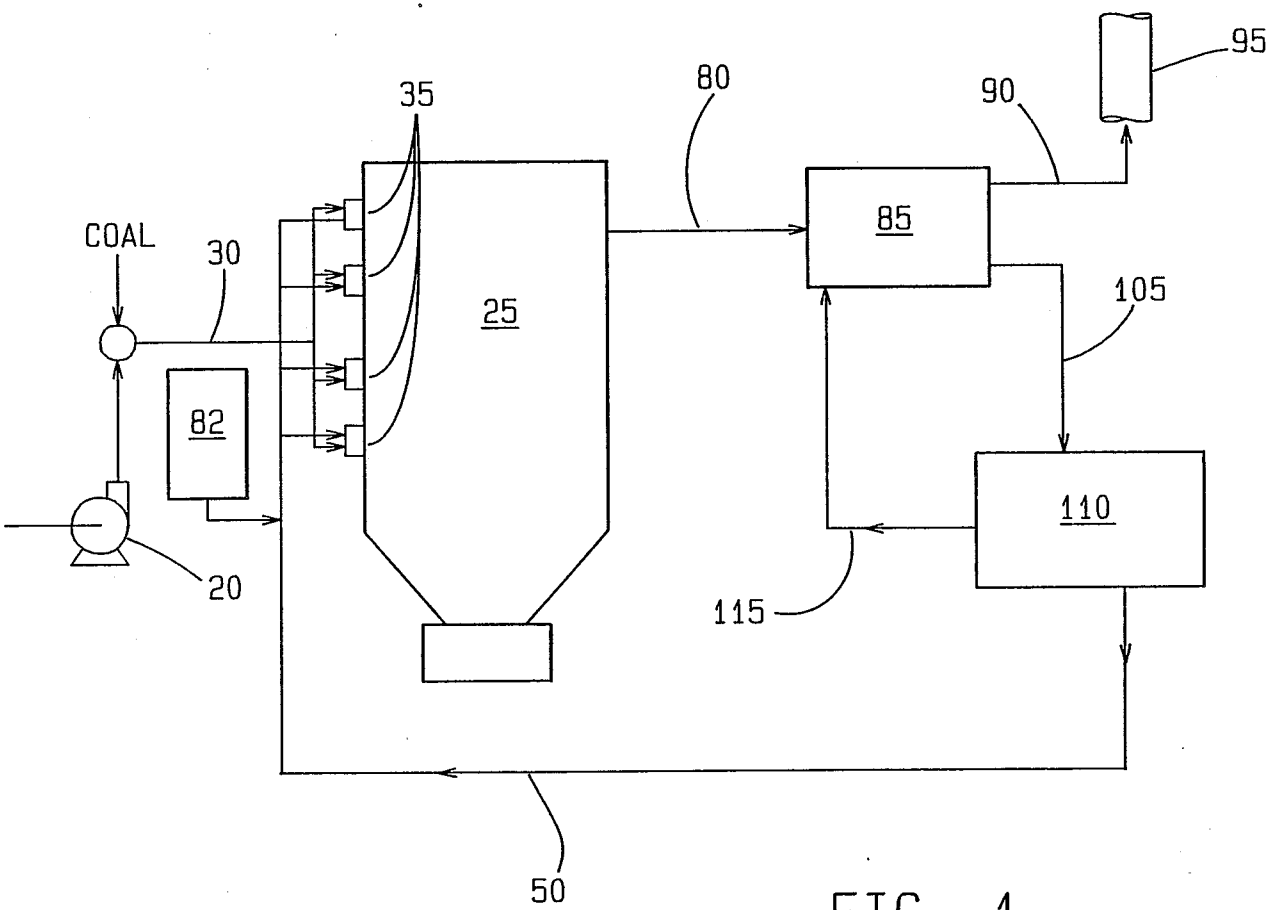
FIG. 1 is a schematic view of one embodiment of a system using the method described and claimed herein, incorporating a scrubber to produce the concentrated $NO_x$ stream.

The invention is described with reference to the drawings. A system, such as that illustrated in FIG. 1, is provided, including a combustor 25. The combustor 25 is suitable for burning carbonaceous materials, such as coal. In the preferred embodiment of the invention, powdered or pulverized coal is mixed with substoichiometric quantities of air (ten to thirty percent of that required for full combustion) from a primary air source 20. The coal-air mixture is provided to combustor 25 through a primary air line 30 into one, or preferably more, burners 35. As illustrated more completely in FIG. 2, the coal-air mixture is provided to each burner through primary air line 30. Secondary air is also introduced into burners 35 via secondary air lines 40, having an outlet 43 downstream of primary air-carbonaceous material injection location (hereinafter "injection location") 45. $NO_x$ from outside sources, or from the recycle stream 50 (shown in FIG. 1) is injected into burners 35 through one of three gas lines: with the coat-air mixture, through primary air line 30; with the secondary air through line 40; or through auxiliary gas line 55. It is preferred to inject the $NO_x$ through auxiliary gas line 55 having outlet 60 upstream of injection location 45. The burner 35 also includes pilot gas line 70 and pilot gas igniter 75 to cause combustion. If more than one burner 35 is used in the combustor 25, as in FIG. 1 (using four burners), it is preferable to inject $NO_x$ through less than all of the burners 35 to allow the $NO_x$ to contact hydrocarbons or other reductants in the system, thereby increasing $NO_x$ reduction efficiency.

Referring back to FIG. 1, combustion gases are then passed out of combustor 25 via effluent gas line 80 into scrubber 85. Gases not absorbed in scrubber 85 pass through discharge line 90 to stack 95. These gases will typically include carbon dioxide, elemental nitrogen, elemental oxygen, and trace amounts of sulfur dioxide and nitrogen oxides.

In the preferred embodiment of the present invention, reductant gases 82, such as alkane gases, are combined with $NO_x$ stream 50 prior to injection into burners 35 with a large volume of air. The reductant gas is mixed with $NO_x$ stream 50 at a temperature below the combustion temperature of the gases. In the preferred embodiment of the invention, the molar ratio of reductant gas to $NO_x$ is greater than or equal to three, and less than fifteen, to permit sufficient reduction. The injection of reductant into the $NO_x$ stream 50 creates an oxygen deficient zone in the injection location 45 (shown in FIG. 2) in burner 35, to achieve maximum reduction of $NO_x$. In the preferred embodiment of the invention, methane is used as the reductant gas. Other alkane gases up to butane may be used, and higher alkanes may also be used, but the higher alkanes will require vaporization before combination with $NO_x$ stream 50. Other reductant gases which will be less useful include elemental hydrogen, carbon monoxide and other hydrocarbon gases.

The present invention may also be used in conjunction with another burner, known as to low $NO_x$ burner. Such a burner (not illustrated) would consist of a primary air stream including carbonaceous material, a secondary air stream, and a tertiary air stream. As above, $NO_x$ would be injected into the burner with the primary air or through the auxiliary gas line, and reductant gases injected with the $NO_x$.

Figure 2:
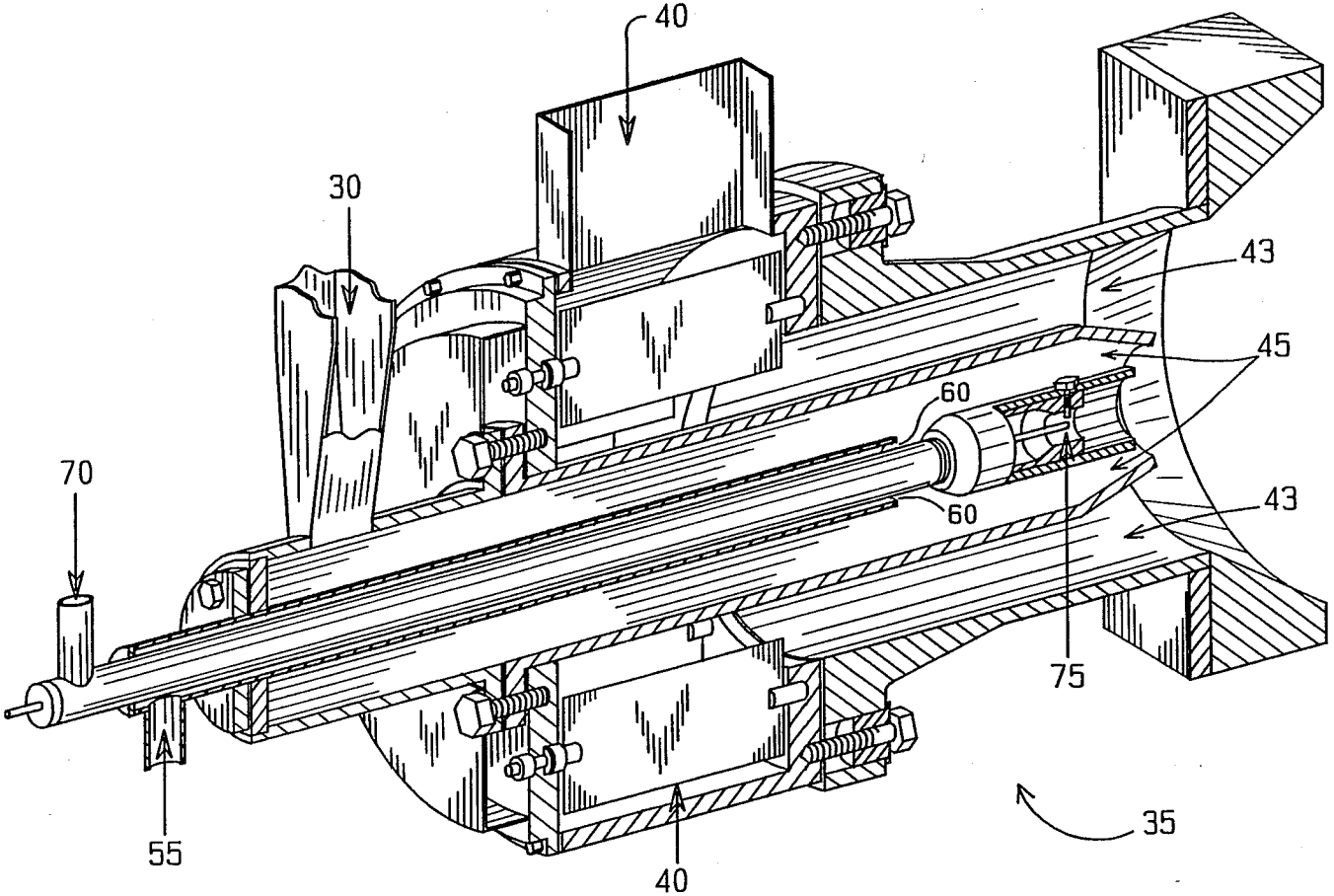
FIG. 2 is a cut-away view of a burner which may be used in the combustor, in accord with the method described and claimed herein.

This technique for $NO_x$ destruction can be used, for example, in conjunction with a regenerable scrubber, as shown in FIG. 1. In such an application, a scrubber 85 is provided for absorbing $NO_x$ in effluent stream 80. The outflow 105 of scrubber 85, containing sorbent and absorbed $NO_x$, is directed to sorbent regeneration means 110, which removes $NO_x$ from the sorbent and returns the cleansed sorbent to scrubber 85 through sorbent line 115. Such a scrubber and regeneration means are described by Walker, U.S. Pat. No. 4,615,780, but other scrubber and regeneration means known in the art will function equally effectively. A concentrated stream 50 of $NO_x$ is also output from regeneration means 110, and is recycled to provide $NO_x$ input into the burners 35 at one or more of gas lines 30, 40 or 55 (as shown in FIG. 2).

The use of the system described above provides higher efficiency of $NO_x$ removal then previously known in the art. This is demonstrated by the specific examples set forth below.

EXAMPLE I

This example was performed in a 227 kg/h coal combustor 25 having four burners 35 (as shown in FIG. 1) set vertically within the combustor. The lowest two burners 35 were injected with $NO_x$ (to simulate an industrial waste gas stream or recycled $NO_x$) provided through the auxiliary gas line 55. No reductant gas was added to the system in this example. One and ninety-two hundredths moles $NO_x$ were injected per mole $NO_x$ produced in the initial combustion. A reduction of 93.9 percent of injected $No_x$ was observed.

EXAMPLE II

In this example, the lowest two of four vertically set burners 35 in a 227 kg/h coal combustor 25 were injected with $NO_x$ (to simulate an industrial waste gas stream of recycled $NO_x$), provided through the auxiliary gas line 55 of the burner. Two and five hundredths moles $NO_x$ were injected per mole of $NO_x$ produced in the initial combustion. Reductant gas, in the form of methane was introduced with the $NO_x$ through auxiliary gas line 55, in the amount of 3.9 moles $CH_4$ per mole $NO_x$ reduced. A reduction of 100 percent of the injected $NO_x$ was observed.

EXAMPLE III

The lowest two of four vertically set burners 35 in a 227 kg/h coal combustor 25 were again injected with $NO_x$ (to simulate an industrial waste gas stream or recycled $NO_x$) along with the coal-air mixture through inlet 30. Two and five hundredths moles $NO_x$ were injected per mole of $NO_x$ produced in the initial combustion. Reductant gas, in the form of methane was introduced with the $NO_x$ through inlet 30, in the amount of 3.9 moles $CH_4$ per mole $NO_x$ reduced. A reduction of 100 percent of the injected $NO_x$ was observed.

Although the present invention is described in terms of specific materials, embodiments and process steps, it will be clear to one skilled in the art that various modifications can be made within the scope of the invention as described in the following claims.

What is claimed is:

1. A method of removing nitrogen oxides from industrial waste gas streams containing high concentrations of nitrogen oxides, or from regenerable flue gas cleanup processes, comprising the steps of:

providing a combustor for particulate carbonaceous material, said combustor having primary and secondary oxidant inlets;

mixing a primary oxidant with said particulate carbonaceous material, said mixture being stoichiometrically deficient in oxidant;

injecting said mixture of primary oxidant and particulate carbonaceous material into a primary oxidant-carbonaceous material injection location;

mixing a combustible reductant with the nitrogen oxides and injecting the mixture of combustible reductant and nitrogen oxides into said primary oxidant-carbonaceous material injection location; and, igniting said primary oxidant, particulate carbonaceous material, combustible reductant and nitrogen oxides in said primary oxidant -carbonaceous material injection location.

2. The method of claim 1 wherein said primary oxidant is air.

3. The method of claim 1 wherein said nitrogen oxides are injected into said primary air-carbonaceous material injection location with said primary oxidant.

4. The method of claim 1 wherein said nitrogen oxides are injected into said primary air-carbonaceous material injection location through an auxiliary gas line.

5. The method of claim 1, wherein said nitrogen oxides and combustible reductant are injected into said primary oxidant-carbonaceous material injection location with said primary oxidant.

6. The method of claim 1, wherein said nitrogen oxides and said combustible reductant are injected into said primary oxidant-carbonaceous material injection location through an auxiliary gas line.

7. The method of claim 1, wherein said combustible reductant is an alkane.

8. The method of claim 7, wherein said nitrogen oxides are mixed with said alkane gas at below the ignition temperature of the alkane gas.

9. The method of claim 1, wherein the molar amount of said combustible reductant is greater than three times the molar amount of nitrogen oxides and less than fifteen times the molar amount of nitrogen oxides.

10. The method of claim 7, wherein the molar amount of said alkane is greater than three times the molar amount of nitrogen oxides and less than fifteen times the molar amount of nitrogen oxides.

11. The method of claim 1, wherein the amount of primary oxidant is less than or equal to three-tenths the amount needed to completely burn said particulate carbonaceous material.

12. The method of claim 2, wherein the amount of air is less than or equal to three-tenths the amount needed to completely burn said particulate carbonaceous material.

13. A method of removing nitrogen oxides from flue gas, comprising the steps of:

providing a combustor for particulate carbonaceous material, said combustor having primary and secondary oxidant inlets;

mixing a primary oxidant with said particulate carbonaceous material, said mixture being stoichiometrically deficient in oxidant;

injecting said mixture of primary oxidant and particulate carbonaceous material into a primary oxidant-carbonaceous material injection location through said primary oxidant inlets;

injecting nitrogen oxides into said primary oxidant-carbonaceous material injection location;

igniting said primary oxidant, nitrogen oxides and particulate carbonaceous material in said primary oxidant-carbonaceous material injection location to create effluent gases and leaving uncombusted particulate carbonaceous material and nitrogen oxides;

passing said effluent gases, uncombusted particulate carbonaceous material and nitrogen oxides into a combustion zone;

igniting said uncombusted particulate carbonaceous material and nitrogen oxides with secondary oxidant in said combustion zone to create additional effluent gases;

removing effluent gases from said combustion zone;

processing said effluent gases in a scrubber to remove nitrogen oxides from said gases and to produce scrubbed effluent gases, said scrubber including a nitrogen oxide sorbent;

discharging said scrubbed effluent gases through a stack;

processing said nitrogen oxide sorbent from said scrubber with regenerating means to produce a concentrated stream of nitrogen oxides and a regenerated stream of nitrogen oxide sorbent;

returning said regenerated stream of nitrogen oxide sorbent; and, returning said concentrated stream of nitrogen oxides to said primary oxidant carbonaceous material injection location.

14. The method of claim 13 wherein said primary oxidant is air.

15. The method of claim 13, wherein said nitrogen oxides are mixed with a combustible reductant prior to injection into said primary oxidant-carbonaceous material injection location.

16. The method of claim 15, wherein said combustible reductant is an alkane.

17. The method of claim 14, wherein said nitrogen oxides are mixed with a combustile reductant prior to injection into said primary oxidant-carbonaceous material injection location.

18. The method of claim 17, wherein said nitrogen oxides and said combustible reductant are injected into said primary oxidant-carbonaceous material injection location with said primary oxidant.

19. The method of claim 17, wherein said combustible reductant is an alkane.

20. The method of claim 16, wherein said nitrogen oxides are mixed with said alkane gas at below the ignition temperature of the alkane gas.

21. The method of claim 14, wherein said nitrogen oxides are mixed with said alkane gas at below the ignition temperature of the alkane gas.

22. The method of claim 16, wherein the molar amount of said combustible reductant is greater than three times the molar amount of nitrogen oxides and less than fifteen times the molar amount of nitrogen oxides.

23. The method of claim 14, wherein the molar amount of said combustible reductant is greater than three times the molar amount of nitrogen oxides and less than fifteen times the molar amount of nitrogen oxides.

24. The method of claim 20, wherein the molar amount of said combustible reductant is greater than three times the molar amount of nitrogen oxides and less than fifteen times the molar amount of nitrogen oxides.

25. The method of claim 16, wherein the molar amount of said combustile reductant is greater than three times the molar amount of nitrogen oxides and less than fifteen times the molar amount of nitrogen oxides.

26. The method of claim 13, wherein the amount of primary oxidant is less than or equal to three-tenths the amount needed to completely burn said particulate carbonaceous material.

27. The method of claim 14, wherein the amount of air is less than or equal to three-tenths the amount needed to completely burn said particulate carbonaceous material.

28. The method of claim 13, wherein said nitrogen oxides are injected into said primary oxidant-carbonaceous material injection location with said primary oxidant.

29. The method of claim 13, wherein said nitrogen oxides are injected into said primary oxidant-carbonaceous material injection location through an auxiliary gas line.

* * * * *